US008347596B2

(12) United States Patent
Rittenhouse et al.

(10) Patent No.: US 8,347,596 B2
(45) Date of Patent: Jan. 8, 2013

(54) METHODS OF FORMING YARN AND APPARATUS FOR TWISTING OR CABLING YARN

(75) Inventors: Ronnie Rittenhouse, Calhoun, GA (US); Peter Ganahi, Ringgold, GA (US)

(73) Assignee: INVISTA North America S.a.r.l., Wilmington, DE (US)

( * ) Notice: Subject to any disclaimer, the term of this patent is extended or adjusted under 35 U.S.C. 154(b) by 184 days.

(21) Appl. No.: 12/921,875

(22) PCT Filed: Mar. 6, 2009

(86) PCT No.: PCT/US2009/036300

§ 371 (c)(1),
(2), (4) Date: Sep. 29, 2010

(87) PCT Pub. No.: WO2009/114408

PCT Pub. Date: Sep. 17, 2009

(65) Prior Publication Data

US 2011/0016840 A1 Jan. 27, 2011

Related U.S. Application Data

(60) Provisional application No. 61/035,441, filed on Mar. 11, 2008.

(51) Int. Cl.
*D01H 1/00* (2006.01)

(52) U.S. Cl. ..... 57/58.52; 57/58.7; 57/58.83; 57/356

(58) Field of Classification Search ..... 57/58.36, 57/58.52, 58.7, 58.83, 356
See application file for complete search history.

(56) References Cited

U.S. PATENT DOCUMENTS

| | | | | | |
|---|---|---|---|---|---|
| 1,219,314 | A | * | 3/1917 | Hubbard | 57/58.52 |
| 1,995,533 | A | * | 3/1935 | Bochmann et al. | 57/58.52 |
| 2,030,110 | A | * | 2/1936 | Keight | 57/360 |
| 2,037,414 | A | * | 4/1936 | Haas | 57/90 |
| RE26,735 | E | * | 12/1969 | Vibber | 57/58.3 |
| 3,490,220 | A | * | 1/1970 | Frentzel-Beyme | 57/58.83 |
| 3,742,693 | A | * | 7/1973 | Greive et al. | 57/58.86 |
| 4,391,087 | A | * | 7/1983 | Greive et al. | 57/58.52 |
| 4,592,195 | A | | 6/1986 | Charbonnier | |
| 4,736,579 | A | * | 4/1988 | Stenmans | 57/58.52 |
| 4,848,075 | A | * | 7/1989 | Frentzel-Beyme | 57/264 |
| 4,856,267 | A | * | 8/1989 | Garner | 57/58.52 |
| 4,856,268 | A | * | 8/1989 | Colli | 57/58.52 |
| 5,263,308 | A | | 11/1993 | Lee et al. | |
| 6,021,631 | A | * | 2/2000 | Prechtel | 57/58.49 |
| 6,098,392 | A | * | 8/2000 | Tung | 57/14 |
| 6,996,966 | B2 | * | 2/2006 | Badiali et al. | 57/58.55 |
| 2008/0098707 | A1 | | 5/2008 | Vega | |
| 2011/0167779 | A1 | * | 7/2011 | Rittenhouse et al. | 57/58.72 |

FOREIGN PATENT DOCUMENTS

| | | |
|---|---|---|
| KR | 1020070048653 | 5/2007 |
| WO | 93/11289 | 6/1993 |

* cited by examiner

*Primary Examiner* — Shaun R Hurley
(74) *Attorney, Agent, or Firm* — Christina Geerlof

(57) ABSTRACT

Briefly described, embodiments of this disclosure include a yam twisting or cabling apparatus, methods of twisting or cabling yarn, and the like.

23 Claims, 1 Drawing Sheet

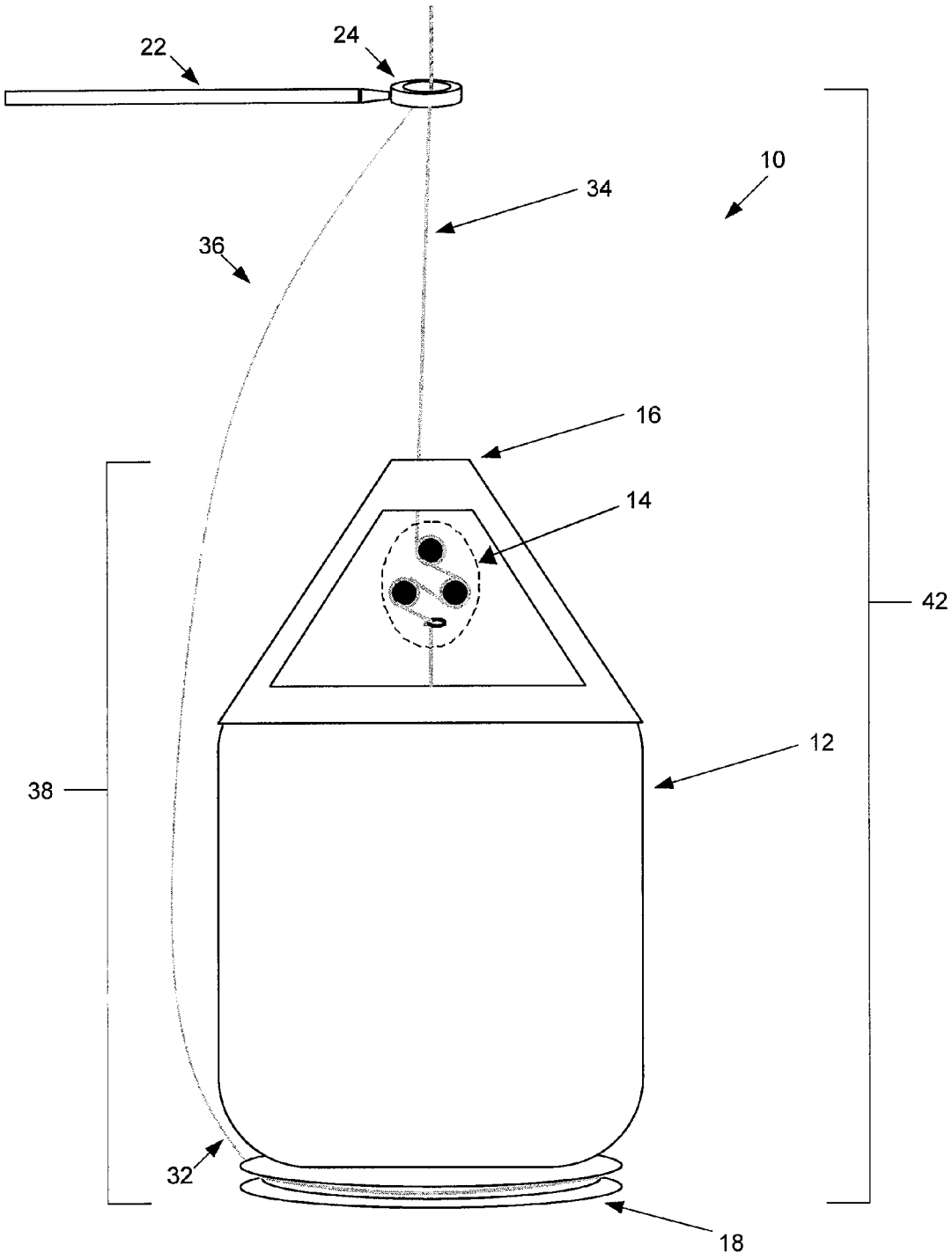
22
24
10
34
36
16
14
42
12
38
32
18

METHODS OF FORMING YARN AND APPARATUS FOR TWISTING OR CABLING YARN

CROSS-REFERENCE TO RELATED APPLICATION

This application claims priority to U.S. provisional application entitled, "METHODS OF FORMING YARN AND APPARATUS FOR TWISTING OR CABLING YARN," having Ser. No. 61/035,441, filed on Mar. 11, 2008, which is entirely incorporated herein by reference.

BACKGROUND

Two or more yarns are often twisted or "cabled" together to form plied yarns having various properties useful in the construction of soft floor coverings (La, tufted rugs and carpets). A standard cabling process involves physically rotating one yarn, fed from a creel, around a second yarn fed from a "bucket", both yarns being under carefully controlled tension, and then winding up the combined yarns in the form of a single, cabled (plied) yarn.

Machines to perform this operation are sold by various manufacturers, including: Oerlikon (Volkmann), Rieter (ICBT), China Textile Machinery Corporation (CTMC), Belmont, and the like. These machines typically include a creel to hold one of the feed yarns, a tension frame to control creel yarn tension, a tube to convey the creel yarn to a spindle, a "bucket", located above the spindle, containing the second feed yarn, tension devices, a bucket lid, and an extension arm (located no more than about 7 inches from the top of the bucket) to carry the creel yarn around the bucket yarn at specified speed (no more than 7200 rpm for over 99% of twisters currently in use and the other fraction of a percent (CTMC) claims 9000 rpm maximum.

Twisting technology is one of the limitations of the carpet industry because although twisting is important to achieve the density and resilience required of tufted carpet, cabled yarns are processed relatively slowly compared to the preceding and subsequent processes. As a result of this industry "bottleneck", a relatively large investment in twisters and process inventory is required.

Yarns are twisted together at frequencies ranging from about one turn to more than eight turns per inch, depending on yarn thickness and the intended effect. The higher the number of turns per inch the slower the operation becomes as the spindle carrying the creel yarn must complete a revolution for each "turn". For example, if two yarns are twisted at about 6000 rpm, at a frequency of two turns per inch, the winding speed of the product will be approximately 3000 inches (83 yards) per minute, neglecting other factors. Doubling turn frequency to four turns per inch would approximately halve the production rate (assuming the yarns are thin enough to permit the higher level of twist). Winding speed for a commercial twisting operation is usually about 50 yards per minute up to about 100 yards per minute achieving rotational speeds of 6000 up to claims of about 9000 rpm for lighter deniers.

Other carpet related yarn processes run much more quickly than cable-twisting does today. Spinning machines wind up at speeds in excess of 3000 yards per minute, while heat setting processes wind up at about 600 yards per minute. Thus, there is a need in the industry to increase cabling speed without deteriorating the properties of the yarn.

SUMMARY

Briefly described, embodiments of this disclosure include yarn twisting or cabling apparatus, methods of twisting or cabling yarn, and the like. One exemplary yarn twisting or cabling apparatus, among others, includes: a bucket having a bucket top and a bucket bottom, a reserve disc, and an adjustable extension arm with a balloon thread guide, wherein the bucket is disposed on the reserve disc so that the bucket bottom is disposed on the reserve disc, wherein the adjustable extension arm is positioned so that the balloon thread guide is positioned above the bucket top along the center line of the bucket, and wherein the balloon thread guide is at least about 7.5 inches above the bucket top, Another exemplary yarn twisting or cabling apparatus, among others, includes: a bucket having a bucket top and a bucket bottom, a reserve disc, and an adjustable extension arm with a balloon thread guide, wherein the bucket is disposed on the reserve disc so that the bucket bottom is disposed on the reserve disc, wherein the adjustable extension arm is positioned so that the balloon thread guide is positioned above the bucket top along the center line of the bucket, and wherein the balloon thread guide is at least about 28 inches above the reserve disc.

In an embodiment, the yarn twisting or cabling apparatus can operate at a twisting speed of greater than about 10,000 rpm.

One exemplary method of twisting or cabling yarn, among others, includes: providing an apparatus such as those described above and operating at a twisting speed of greater than about 10,000 rpm.

BRIEF DESCRIPTION OF THE DRAWINGS

The disclosure can be better understood with reference to the following drawings. The components in the drawings are not necessarily to scale, emphasis instead being placed upon clearly illustrating the principles of the present disclosure.

FIG. 1 illustrates an embodiment of a yarn twisting or cabling apparatus.

DETAILED DESCRIPTION

Before the present disclosure is described in greater detail, it is to be understood that this disclosure is not limited to particular embodiments described, as such may, of course, vary. It is also to be understood that the terminology used herein is for the purpose of describing particular embodiments only, and is not intended to be limiting, since the scope of the present disclosure will be limited only by the appended claims.

Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, the preferred methods and materials are now described.

All publications and patents cited in this specification are herein incorporated by reference as if each individual publication or patent were specifically and individually indicated to be incorporated by reference and are incorporated herein by reference to disclose and describe the methods and/or materials in connection with which the publications are cited. The citation of any publication is for its disclosure prior to the filing date and should not be construed as an admission that the present disclosure is not entitled to antedate such publication by virtue of prior disclosure. Further, the dates of publication provided could be different from the actual publication dates that may need to be independently confirmed.

Embodiments of the present disclosure will employ, unless otherwise indicated, techniques of fibers, yarns, textiles, processes with making yarn, and the like, which are within the skill of the art. Such techniques are explained fully in the literature.

It must be noted that, as used in the specification and the appended claims, the singular forms "a," "an," and "the" include plural referents unless the context clearly dictates otherwise. Thus, for example, reference to "a support" includes a plurality of supports. In this specification and in the claims that follow, reference will be made to a number of terms that shall be defined to have the following meanings unless a contrary intention is apparent.

Definitions

As used herein, the term "fiber" refers to filamentous material that can be used in fabric and yarn as well as textile fabrication. One or more fibers can be used to produce a fabric or yarn. The yarn can be fully drawn or textured according to methods described herein.

As used herein, the term "cable" or "cabling" refers to twisting together two or more yarns.

As used herein, the term "cabled yarn" refers to two or more yarns twisted together.

As used herein, the term "conventional twister" refers to a system of producing a yarn by twisting together two or more single yarns simultaneously.

As used herein, the term "folded yarn" or "plied yarn" is a yarn in which two or more single yarns are twisted together in one operation (e.g., two-folded yarn (two-ply yarn), three-fold yarn (three ply yarn), and the like).

As used herein, the term "Tpi" refers to turns per inch (e.g., tpi defines a degree of twist which is the number of turns or twists per unit length), As used herein, the term "twist direction" refers to "s" or "z" according to which of these letters has its center inclined in the same direction as the surface elements of a given twisted yarn, when the yarn is viewed vertically (e.g., twisting in the s-direction is clockwise and the z-direction is counter-clockwise).

Twisting speed refers to the spinning speed of the reserve disc and is indicated in revolutions per minute (rpm).

Take-up speed is indicated by the linear velocity of the yarn or fiber and is the speed at which fiber or yarn is drawn from or pulled through a portion of a process.

Winding speed is indicated by the linear velocity of the yarn or fiber and is the speed at which the fiber or yarn is wound on a tube or package.

Number of Crimps is a measure of the number of loops in the filament.

Straight (%) refers to the percentage of straight line space curve or the uncrimped portion of the fiber.

Helical Crimp (%) is the percentage of helical-like space curve.

Planar Crimp (%) is the percentage of planar-like, i.e. sawtooth, space curve.

Curvilinear Crimp (%) is the percentage of complex space curve not in any of the aforementioned categories.

Discussion

Embodiments of the present disclosure provide for methods of forming yarn, apparatus for twisting or cabling yarn (also referred to as "yarn twisting or cabling apparatus"), and the like. In the present disclosure, two or more bulk continuous fibers or synthetic yarns (e.g., nylon or other polyamides) are used to create a piled yarn (two-ply, three-ply, or more) that can be used in textiles such as rugs, carpets, and the like. Embodiments of the present disclosure provide for apparatus and methods that increase the rotational speed of twisting of two or more yarns to permit higher process productivity (winding speed), while maintaining the continuity of the winding process and the quality of the product.

Embodiments of the present disclosure relate to cabling or twisting two or more yarns together to form a single plied yarn having about 1 to 10 twists per inch (TPI) or increments therein. Embodiments of the present disclosure provide for an apparatus that can operate at unusually high speeds (about 400 to 500% faster and even about 1000% faster than current technologies) without deterioration of either process continuity or the properties (including crimp and bulk) of the plied yarn. In particular, apparatus of the present disclosure are 2-3 times (or greater) more productive than processes previously used. In particular, the increase in productivity is derived from an improved relationship between the length of the creel yarn traveling around the bucket before the cabling point (at the ballooning thread guide) and the diameter of the path of the creel yarn. Embodiments of the present disclosure produce this relationship by increasing the distance from the top of a standard bucket (or reserve disc located at the bottom of the bucket) and a balloon thread guide, where the balloon thread guide is at the end of an extension arm. Additional details regarding the apparatus and methods will be discussed below.

Embodiments of the present disclosure use the relationship between twisting speed and the shape of the path the creel yarn traces around the bucket to produce an increase in processing speed and productivity. The shape of the path of the creel yarn, called the "balloon", can be directly observed as the creel yarn travels rapidly around the bucket. The creel yarn and the bucket yarn converge within the balloon thread guide located at a point about 0.5 to 7 inches above the top of a standard bucket along the bucket centerline. It is generally understood that, for any given rotational velocity (revolutions per minute), a smaller balloon diameter reduces drag on the creel yarn in the balloon. Thus, commercially available twisters attempt to minimize the balloon diameter through the use of balloon restriction limiters and by the positioning of the balloon thread guide that is restricted at the high end to 7 inches, but not higher than 7 inches since the design and configuration apparatus limits the height to 7 inches.

As mentioned above, embodiments of the present disclosure operate at much higher rotational speeds than commercial twisters (about 400 to 1000% faster) and are able to achieve a more elongated balloon shape that reduces drag and enables higher speed. Thus, by incorporating this new understanding into embodiments of the present disclosure, rotational speeds far exceeding the currently obtainable speeds with commercial apparatus for the same yarn combinations can be achieved. In an embodiment, by incorporating this new understanding into embodiments of the present disclosure, rotational speeds of at least four times higher than currently obtainable with commercial apparatus for the same yarn combinations can be achieved. Although the product (e.g., two-ply yarn, three-ply, or more) of the processes and apparatus of the present disclosure are formed at higher speeds, the product once incorporated into a carpet, for example, does not show any adverse effects due to the non-standard processing. Neither crimp nor bulk is compromised.

An embodiment of the yarn twisting or cabling apparatus is shown in FIG. 1. The apparatus 10 includes a creel peg (not shown), a tension frame (not shown) (controls creel tension), tube transfer to spindle housing (not shown), spindle (not shown), "bucket" 12, bucket tension devices 14, bucket top 16, reserve disc 18, and an adjustable extension arm 22 with balloon thread guide 24. In an embodiment, the balloon thread guide 24 can be positioned at least 7.5 or at least about 7.5 inches above the top of the bucket (a standard bucket, 20.5 inches). In other embodiments, the balloon thread guide 24 can be positioned from 7.5 to about 47.5 inches, about 7.5 to 47.5 inches, about 10 to 30 inches, and about 10 to 22 inches above the top of the bucket (a standard bucket having a height of about 20.5 inches). It should be noted that the balloon thread guide 24 could be moved in less than 1 inch increments within the ranges noted above. The diameter of the balloon thread guide 24 is about 0.5 to 6 inches or about 1 inch. In an embodiment, the adjustable extension arm 22 having the balloon thread guide 24 is separate, attached to, or is part of the yarn twisting or cabling apparatus, which may include one or more distinct structures.

In an embodiment, the dimensions of the bucket 12 are at standard dimensions (e.g., a height (38) of about 20.5 inches). The reserve disc 18 has a diameter of about 7 inches. In an embodiment, the distance 42 from the reserve disc to the balloon thread guide 24 is greater than 28 inches or greater than about 28 inches. In other embodiments, the distance 42 from the reserve disc to the balloon thread guide 24 is 28 to about 68 inches, about 28 to 68 inches, about 30 to 58 inches, or about 30 to 48 inches, It should be noted that the balloon thread guide 24 could be moved in less than 1 inch increments within the ranges noted above (e.g., the lower range could be about 28, 29, 30, 31, 32, 33, 34, 35 inches, and so on, while the upper limit could be 68, 67, 66, 65, 64, 63, 62, 61 inches, and so on, and combinations of these lower and upper levels). In any of the embodiments noted herein, the distance between the top of the bucket and the balloon thread guide is always greater than 7 inches.

In short, a creel yarn (first yarn) 32 is disposed on the creel peg. The creel yarn 32 is guided through the tension frame and to the reserve disc 18. The tension applied to the creel yarn 32 is about 100 g to 1000 g or about 200 g to 300 g. The creel yarn 32 is wrapped around the reserve disc 18 about 0.75 to 2.5 wraps. Subsequently, the creel yarn 32 is guided to the balloon thread guide 24 (forms the balloon 36), where it is cabled with the bucket yarn 34. The bucket yarn 34 is disposed in the bucket 12. The bucket yarn 34 is guided through the bucket tension devices 14 to the balloon thread guide 24, where it is cabled with the creel yarn 32. The bucket tension is about 100 g to 1000 g or about 200 g to 300 g. It should be noted that not all of the features of the apparatus are described for reasons of clarity and one skilled in the art would know how to properly set up the apparatus to run the twisting or cabling process.

Twist level (TPI) is controlled by the take-up speed and the speed at which the creel yarn is spinning (twisting speed) around the bucket. The ratio between the take-up speed and the twisting speed results in a specific number of twists or turns per inch.

In general, the twisting speed is greater than about 10,000 rpm and the twisting speed is up to about 100,000 rpm. In other embodiments, the twisting speed is: about 10,000 to 100,000 rpm, about 15,000 to 100,000 rpm, about 10,000 to 60,000 rpm, about 15,000 to 60,000 rpm, about 10,000 to 35,000 rpm, or about 15,000 to 35,000 rpm. It should be noted that the twisting speed could be in increments of about 1000 or 5000 rpm within the ranges noted above (e.g., the lower range could be about 5000, 10,000, 11,000, 12,000, 13,000, 14,000, 15,000, 16,000, 17,000, 18,000, 19,000, 25,000, 30,000 rpm, and so on, while the upper limit could be 100, 000, 95,000, 90,000, 85,000, 80,000, 75,000, 70,000, 65,000, 60,000, 59,000, 58,000, 50,000, 40,000, 39,000, 38,000, 37,0000 rpm, and so on, and combinations of these lower and upper levels).

In general, the take-up speed is about 30 to 2540 m/min. The take-up speed used for a given operation depends, at least in part, upon the twisting speed and the twists per inch of the yarn. It should be noted that the speeds, tensions, and/or the TPI could be adjusted based on the type of yarns, mix of yarns, denier of each yarn, number of filaments per yarn, denier per filament, finish on yarn, and combinations thereof. Thus, the parameters noted above could change based on changing one or more of the variables mentioned above.

In an embodiment, for yarn having 8 TPI with the twisting speed at about 10,000 rpm, the take-up speed is about 32 m/min. For yarn having 1 TPI, the take-up speed is about 254 m/min. In this regard, the take-up speed varies with the TPI. In another embodiment, for yarn having 8 or 1 TPI with the twisting speed at 15,000 rpm, the take-up speed is about 47 and 381 m/min, respectively. In another embodiment, for yarn having 8 or 1 TPI with the twisting speed at 35,000 rpm, the take-up speed is about 111 and 889 m/min, respectively. In another embodiment, for yarn having 8 or 1 TPI with the twisting speed at 60,000 rpm, the take-up speed is about 190 and 1524 m/min, respectively. In another embodiment, for yarn having 8 or 1 TPI with the twisting speed at 100,000 rpm, the take-up speed is about 317 and 2540 m/min, respectively. As mentioned above, the TPI can be about 1 to 10, and any increment therein. As a result, the take-up speed can be adjusted accordingly.

The creel yarn can have a denier of about 300 to 6000. The bucket yarn can have a denier of about 300 to 6000. The creel yarn and the bucket yarn can be the same or different yarns having the same or different deniers.

As mentioned above, the present disclosure describes that the cable-twisting speed (take up speed) can be substantially increased by changing the shape of the path of the creel yarn as it travels around the "bucket" during the cabling process. The creel yarn path normally extends outward, away from the axis of spindle rotation, by the momentum of the yarn as it travels at high rotational velocity around the bucket. This extension and the distended shape (balloon) formed by the yarn in motion is visible to the naked eye.

In one embodiment, the apparatus includes positioning the balloon thread guide so that the balloon shape is substantially extended in the axial direction. Although not intending to be bound by theory, the elongation of the balloon appears to reduce creel yarn drag and tension which in turn enables much higher rotational speeds with a similar expenditure of energy, which is a surprising and unexpected result. It appears that the configuration of the present disclosure minimizes wind resistance to the creel yarn as it rotates around the bucket. The lower balloon circumference represents a much smaller translational distance per revolution, and therefore the linear velocity of the creel yarn through the air is less for any given angular velocity (rpm). Furthermore, a smaller balloon diameter represents lower angular momentum for any given rotational velocity, so as the balloon diameter is reduced, rotational speed is increased for a given machine setting. The balloon profile is enabled by a specific relationship between the balloon thread guide and the take-off point of the bucket yarn, which is substantially different from the other processes by about a few hundred percent (e.g., about 100 to 300% or more).

As noted above, the yarn can include a polymer fiber. The polymer fiber can include fibers such as, but not limited to, a polyamide fiber, a polyester fiber, a polypropylene fiber, and the like. In particular, the polymer fiber can be a polyamide fiber. The term "polyamide" as used herein means the well-known fiber-forming substance that is a long-chain synthetic polyamide. The polyamides can be a homopolymer, copolymer, or terpolymer, or mixtures of polymers. Embodiments of polyamide fibers include, but are not limited to, polyhexamethylene adipamide (nylon 6,6); polycaproamide (nylon 6); polyenanthamide (nylon 7); poly(10-aminodecanoic acid) (nylon 10); polydodecanolactam (nylon 12); polytetramethylene adipamide (nylon 4,6); polyhexamethylene sebacamide homopolymer (nylon 6,10); a polyamide of n-dodecanedioic acid and hexamethylenediamine homopolymer (nylon 6,12); and a polyamide of dodecamethylenediamine and n-dodecanedioic acid (nylon 12,12). In addition, the polyamide can be a copolymer polyamide (e.g., a polyamide polymer derived from two or more dissimilar monomers). In particular, the polyamide fiber is polyhexamethylene adipamide and copolymers thereof. The copolymer may contain a variety of comonomers known in the art, and in particular, may contain methylpentamethylene diamine and isophthalic acid. The polymer or copolymer can also include a variety of additives such as delusterants, pigments, stabilizers, antistatic agents, and the like.

EXAMPLES

Now having described the embodiments of the present disclosure, in general, the following Examples describe some additional embodiments of the present disclosure. While embodiments of the present disclosure are described in connection with the following examples and the corresponding text and figures, there is no intent to limit embodiments of the present disclosure to this description. On the contrary, the intent is to cover all alternatives, modifications, and equivalents included within the spirit and scope of embodiments of the present disclosure.

Example 1

A nylon 6,6 creel yarn having a denier of 2615 and a nylon 6,6 bucket yarn having a denier of 2615 were twisted at a rate of 19,300 rpm (twisting speed) with the take-up speed set so that a twist level of 3 TPI was obtained. The high speed twisted yarn was then heatset along with standard twisted yarn to show any differences in the two twisting processes. Filament form analysis was performed in order to determine the changes, if any, in the amount or type of crimp in the traditionally twisted and the high speed twisted yarn. Both yarns had the same crimp value however the type of crimp (helical, planar, and curvilinear) was statistically different; the high speed twisted yarn having slightly higher curvilinear crimp and slightly lower helical crimp. It should be noted that experienced and trained observers of carpet properties generally agreed that carpets formed from the yarns of the process of the present disclosure were noticeably higher in bulk when compared with the same yarns processed to the same twist level on standard equipment.

The table below shows illustrative raw data obtained and the averages for each value. The P-values show that despite the crimp being statistically not different (P-value>0.05), the helical and curvilinear percentages of said crimp are statistically different (P-value<0.05). This leads to a belief that the greater curvilinear crimp could explain the increase in bulk for the high speed twisted yarn.

| Twisting Speed (rpm) | Straight (%) | Helical Crimp (%) | Planar Crimp (%) | Curvilinear Crimp (%) | # of Crimps |
|---|---|---|---|---|---|
| 6950 | 5.60 | 59.96 | 27.80 | 6.64 | 52 |
| 6950 | 2.28 | 71.37 | 26.14 | 0.21 | 54 |

-continued

| Twisting Speed (rpm) | Straight (%) | Helical Crimp (%) | Planar Crimp (%) | Curvilinear Crimp (%) | # of Crimps |
|---|---|---|---|---|---|
| 6950 | 0.83 | 63.49 | 25.10 | 10.58 | 54 |
| 6950 | 11.83 | 79.25 | 7.26 | 1.66 | 52 |
| 6950 | 2.90 | 74.27 | 19.09 | 3.73 | 57 |
| 6950 | 3.11 | 60.79 | 16.60 | 19.50 | 53 |
| 6950 | 3.53 | 85.27 | 11.20 | 0.00 | 53 |
| 6950 | 1.87 | 63.07 | 26.56 | 8.51 | 53 |
| 6950 | 8.92 | 81.74 | 6.85 | 2.49 | 49 |
| 6950 | 3.11 | 85.89 | 9.75 | 1.24 | 61 |
| 6950 | 8.92 | 83.40 | 6.22 | 1.45 | 53 |
| 6950 | 3.11 | 62.45 | 20.95 | 13.49 | 55 |
| 19300 | 0.21 | 69.09 | 9.96 | 20.75 | 55 |
| 19300 | 1.66 | 68.05 | 17.01 | 13.28 | 59 |
| 19300 | 12.03 | 42.74 | 39.21 | 6.02 | 51 |
| 19300 | 0.62 | 62.03 | 13.49 | 23.86 | 62 |
| 19300 | 0.00 | 73.44 | 10.79 | 15.77 | 61 |
| 19300 | 2.28 | 58.92 | 29.05 | 9.75 | 53 |
| 19300 | 0.41 | 62.86 | 24.27 | 12.45 | 56 |
| 19300 | 0.62 | 66.81 | 16.60 | 15.98 | 55 |
| 19300 | 21.16 | 62.86 | 15.98 | 0.00 | 45 |
| Average (6950) | 4.67 | 72.58 | 16.96 | 5.79 | 54 |
| Average (19300) | 4.33 | 62.98 | 19.59 | 13.09 | 55 |
| 2-sample T P-value | 0.902 | 0.033 | 0.520 | 0.028 | 0.491 |

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. The term "about" can include ±1%, ±2%, ±3%, ±4%, ±5%, ±6%, ±7%, ±8%, ±9%, or ±10%, or more of the numerical value(s) being modified. The value of "about" will not be outside of a reasonable amount considering the teachings of the present disclosure. In addition, the phrase "about 'x' to 'y'" includes "about 'x' to about 'y'".

Many variations and modifications may be made to the above-described embodiments. All such modifications and variations are intended to be included herein within the scope of this disclosure and protected by the following claims.

The invention claimed is:

1. A yarn twisting or cabling apparatus comprising: a bucket having a bucket top and a bucket bottom, a reserve disc, and an adjustable extension arm with a balloon thread guide, wherein the bucket is disposed on the reserve disc so that the bucket bottom is disposed on the reserve disc, wherein the adjustable extension arm is positioned so that the balloon thread guide is positioned above the bucket top along the center line of the bucket, and wherein the balloon thread guide is at least about 7.5 inches above the bucket top;

wherein the apparatus is adapted to being operated at twisting speeds of greater than about 10,000 rpm.

2. The yarn twisting or cabling apparatus of claim 1, wherein the balloon thread guide is 7.5 to about 47.5 inches above the bucket top.

3. The yarn twisting or cabling apparatus of claim 1, wherein the balloon thread guide is about 10 to 30 inches above the bucket top.

4. The yarn twisting or cabling apparatus of claim 1, wherein the balloon thread guide is about 10 to 20 inches above the bucket top.

5. The yarn twisting or cabling apparatus of claim 1, wherein the apparatus is adapted to being operated at twisting speeds of up to about 100,000 rpm.

6. The yarn twisting or cabling apparatus of claim 1, wherein the apparatus is adapted to being operated at twisting speeds of about 10,000 to 60,000 rpm.

7. The yarn twisting or cabling apparatus of claim 1, wherein the apparatus is adapted to being operated at twisting speeds of about 15,000 to 35,000 rpm.

8. The yarn twisting or cabling apparatus of claim 1, wherein the bucket is about 20.5 inches in height, wherein the balloon thread guide is 7.5 to about 47.5 inches above the bucket top, and wherein the apparatus is adapted to being operated at twisting speeds of up to about 100,000 rpm.

9. A yarn twisting or cabling apparatus comprising: a bucket having a bucket top and a bucket bottom, a reserve disc, and an adjustable extension arm with a balloon thread guide, wherein the bucket is disposed on the reserve disc so that the bucket bottom is disposed on the reserve disc, wherein the adjustable extension arm is positioned so that the balloon thread guide is positioned above the bucket top along the center line of the bucket, and wherein the balloon thread guide is at least about 28 inches above the reserve disc;

wherein the apparatus is adapted to being operated at twisting speeds of greater than about 10,000 rpm.

10. The yarn twisting or cabling apparatus of claim 9, wherein the balloon thread guide is 28 to 68 inches above the reserve disc.

11. The yarn twisting or cabling apparatus of claim 9, wherein the balloon thread guide is about 30 to 58 inches above the reserve disc.

12. The yarn twisting or cabling apparatus of claim 9, wherein the balloon thread guide is about 30 to 48 inches above the reserve disc.

13. The yarn twisting or cabling apparatus of claim 9, wherein the apparatus is adapted to being operated at twisting speeds of about 15,000 to 35,000 rpm and wherein the balloon thread guide is about 30 to 48 inches above the reserve disc.

14. A method of twisting or cabling yarn, comprising: providing an apparatus of claim 1; and operating at a twisting speed of greater than about 10,000 rpm.

15. The method of claim 14, wherein operating includes operating at a twisting speed of about 10,000 to 60,000 rpm.

16. The method of claim 14, wherein operating includes operating at a twisting speed of about 15,000 to 35,000 rpm.

17. The method of claim 14, wherein operating includes operating at a twisting speed of up to about 100,000 rpm, wherein the bucket is about 20.5 inches in height, and wherein the balloon thread guide is 7.5 to about 47.5 inches above the bucket top.

18. The method of claim 14, wherein operating includes operating at a twisting speed of up to about 100,000 rpm, wherein the bucket is about 20.5 inches in height, and wherein the balloon thread guide is about 10 to 30 inches above the bucket top.

19. The method of claim 14, wherein operating includes operating at a twisting speed of up to about 100,000 rpm, wherein the bucket is about 20.5 inches in height, and wherein the balloon thread guide is about 10 to 20 inches above the bucket top.

20. The method of claim 14, wherein operating includes operating at a twisting speed of up to about 100,000 rpm and wherein the balloon guide thread is about 28 to 68 inches above the reserve disc.

21. The method of claim 14, wherein operating includes operating at a twisting speed of up to about 100,000 rpm and wherein the balloon guide thread is about 30 to 58 inches above the reserve disc.

22. The method of claim 14, wherein operating includes operating at a twisting speed of up to about 100,000 rpm and wherein the balloon guide thread is about 30 to 48 inches above the reserve disc.

23. A method of twisting or cabling yarn, comprising:

providing an apparatus of claim 9; and operating at a twisting speed of greater than about 10,000 rpm.

* * * * *